US009180572B2

(12) United States Patent
Wang et al.

(10) Patent No.: US 9,180,572 B2
(45) Date of Patent: Nov. 10, 2015

(54) CHEMICAL MECHANICAL POLISHING CONDITIONER AND MANUFACTURING METHODS THEREOF

(71) Applicant: Kinik Company, Taipei (TW)

(72) Inventors: Chia-Chun Wang, Taipei (TW); Kai-Hsiang Chang, Taipei (TW); Chung-Yi Cheng, Taipei (TW); Wen-Jen Liao, Taipei (TW)

(73) Assignee: KINIK COMPANY, Taipei (TW)

( * ) Notice: Subject to any disclaimer, the term of this patent is extended or adjusted under 35 U.S.C. 154(b) by 104 days.

(21) Appl. No.: 14/063,230

(22) Filed: Oct. 25, 2013

(65) Prior Publication Data

US 2014/0127983 A1 May 8, 2014

(30) Foreign Application Priority Data

Nov. 7, 2012 (TW) ..... 101141305 A

(51) Int. Cl.
*B24B 53/017* (2012.01)
*B24D 18/00* (2006.01)

(52) U.S. Cl.
CPC ..... *B24B 53/017* (2013.01); *B24D 18/0009* (2013.01)

(58) Field of Classification Search
CPC .... B24B 53/017; B24B 53/02; B24B 53/047; B24D 3/06
USPC ..... 451/443, 444; 51/293, 297, 298, 307, 51/309
See application file for complete search history.

(56) References Cited

U.S. PATENT DOCUMENTS

| | | | | |
|---|---|---|---|---|
| 4,448,591 | A * | 5/1984 | Ohno | 51/298 |
| 7,690,971 | B2 * | 4/2010 | Sung | 451/443 |
| 2009/0325472 | A1 * | 12/2009 | Wu et al. | 451/443 |
| 2010/0273402 | A1 * | 10/2010 | Shimizu | 451/56 |
| 2012/0244790 | A1 * | 9/2012 | Sung | 451/443 |
| 2014/0273772 | A1 * | 9/2014 | Chou et al. | 451/443 |

* cited by examiner

*Primary Examiner* — Monica Carter
*Assistant Examiner* — Marcel Dion
(74) *Attorney, Agent, or Firm* — Muncy, Geissler, Olds & Lowe, P.C.

(57) ABSTRACT

The present invention relates to a method for manufacturing a chemical mechanical polishing conditioner, comprising: (A) providing a non-planar substrate; (B) providing a binding layer disposed on the surface of the non-planar substrate; (C) providing a plurality of abrasive particles embedded in a surface of the binding layer, and (D) heat curing the binding layer, such that the non-planar substrate is deformed into a planar substrate during curing the binding layer, and the abrasive particles are fixed to a surface of the planar substrate by the binding layer; wherein, after step (D), tips of the abrasive particles have a leveled height. Therefore, the present can effectively improve the problem of thermal deformation of the substrate of the chemical mechanical polishing conditioner during a heat curing process, and enhance surface flatness of the chemical mechanical polishing conditioner.

10 Claims, 4 Drawing Sheets

CHEMICAL MECHANICAL POLISHING CONDITIONER AND MANUFACTURING METHODS THEREOF

CROSS REFERENCE TO RELATED APPLICATION

This application claims the benefits of the Taiwan Patent Application Serial Number 101141305, filed on Nov. 7, 2012, the subject matter of which is incorporated herein by reference.

BACKGROUND OF THE INVENTION

1. Field of the Invention

The present invention relates to a chemical mechanical polishing conditioner, and more particularly to a chemical mechanical polishing conditioner which may provide deformation compensation for a substrate.

2. Description of Related Art

Chemical mechanical polishing (CMP) is a common polishing process in various industries, which can be used to grind the surfaces of various articles, including ceramics, silicon, glass, quartz, or a metal chip. In addition, with the rapid development of integrated circuits, chemical mechanical polishing becomes one of the common techniques for wafer planarization due to its ability to achieve whole planarization.

During the chemical mechanical polishing process of semiconductor, impurities or uneven structure on the surface of a wafer is removed by a polishing pad in contact therewith (or semiconductor element) with optional use of slurry, through the chemical reaction and mechanical force. When the polishing pad has been used for a certain period of time, the polishing performance and efficiency are reduced because the debris produced in the polishing process may accumulate on the surface of the polishing pad. Therefore, a conditioner can be used to condition the surface of the polishing pad, such that the surface of the polishing pad is re-roughened and maintained at an optimum condition for polishing. In the process for manufacturing a conditioner, it is necessary to dispose an abrasive layer by mixing abrasive particles and a binding layer on the substrate surface; and to fix the abrasive layer to the surface of the substrate by brazing or sintering methods. However, during curing of the abrasive layer, the surface of the substrate may be deformed because of the difference in thermal expansion coefficient between the abrasive layer and the substrate, thus destroying flatness of the abrasive particles of the conditioner and thereby adversely affecting the polishing efficiency and service life of the conditioner.

Conventionally, the surface flatness of a chemical mechanical polishing conditioner is typically controlled by two ways. One way is to dispose the abrasive particles and the binding layer on the surface of the substrate, followed by pressing down the abrasive particles using a rigid plate to embed and fix the abrasive particles into the abrasive layer such that the surfaces of the abrasive particles and the rigid flat may have the same flatness. Another way is to dispose the abrasive particles into a recess of a mold, followed by covering the non-working surface of the abrasive particles with a binding layer and a substrate, and performing heat curing, and finally, flipping the mold upside down to separate the cured chemical mechanical polishing conditioner from the recess of the mold. However, in the above two methods for manufacturing the chemical mechanical polishing conditioner, during heat-curing the binding layer, the difference in thermal expansion coefficient between the binding layer and the substrate may result in deformation of the substrate of the chemical mechanical polishing conditioner after curing, which in turn results in deformation of the surface of the chemical mechanical polishing conditioner and destroys the flatness of the abrasive particles of the conditioner.

Therefore, what is needed is to develop a chemical mechanical polishing conditioner with surface flatness, which cannot only avoid the deformation of the substrate of the chemical mechanical polishing conditioner during curing, but also control the surface flatness of the chemical mechanical polishing conditioner.

SUMMARY OF THE INVENTION

An object of the present invention is to provide a chemical mechanical polishing conditioner, to avoid the deformation of the substrate of the chemical mechanical polishing conditioner during curing, so as to achieve the surface flatness of the chemical mechanical polishing conditioner.

To achieve the above object, the present invention provides a chemical mechanical polishing conditioner, comprising: a planar substrate having a planar surface; a binding layer disposed on a surface of the planar substrate; and a plurality of abrasive particles embedded in a surface of the binding layer and fixed to the surface of the planar substrate by the binding layer, wherein, tips of the abrasive particles have a leveled height.

In the chemical mechanical polishing conditioner of the present invention, the planar substrate may be formed from a non-planar substrate which is deformed during curing the binding layer, wherein a surface of the non-planar substrate has a center surface and an outer edge surface, and a working surface is formed between the center surface and the outer edge surface.

In the chemical mechanical polishing conditioner of the present invention, the working surface may have a non-planar contour, wherein the non-planar contour may be spherical or non-spherical.

In the chemical mechanical polishing conditioner of the present invention, a height difference between the center surface and the outer edge surface may be 5-5000 μm. In a preferred aspect of the present invention, a height difference between the center surface and the outer edge surface may be 120 μm.

In the chemical mechanical polishing conditioner of the present invention, the planar substrate may be made of stainless steel, mold steel, metal alloy, or ceramic material, etc. In a preferred aspect of the present invention, the planar substrate may be made of type 316 stainless steel having a thermal expansion coefficient of about 16 ppm/° C.

In the chemical mechanical polishing conditioner of the present invention, the planar substrate may have a thickness of 3-50 mm and a diameter of 10-360 mm. In a preferred aspect of the present invention, the planar substrate may have a thickness of 6 mm and a diameter of 100 mm.

In the chemical mechanical polishing conditioner of the present invention, the binding layer may be a brazing layer, a resin layer, a electroplating layer, or a ceramic layer. In a preferred aspect of the present invention, the binding layer may be a brazing layer. The brazing layer may be at least one selected from the group consisting of iron, cobalt, nickel, chromium, manganese, silicon, aluminum, and combinations thereof, having a thermal expansion coefficient of about 14-15 ppm/° C.

In the chemical mechanical polishing conditioner of the present invention, the abrasive particles may be diamond or cubic boron nitride. In a preferred aspect of the present invention, the abrasive particles may be diamond. In addition, in the chemical mechanical polishing conditioner of the present invention, the abrasive particles may have a particle size of 20-450 μm. In a preferred aspect of the present invention, the abrasive particles may have a particle size of 200 μm.

Another object of the present invention is to provide a chemical mechanical polishing to provide a method for manufacturing a chemical mechanical polishing conditioner to obtain the above-described chemical mechanical polishing conditioner, and effectively avoid the deformation of the substrate of the chemical mechanical polishing conditioner during curing, so as to achieve the surface flatness of the chemical mechanical polishing conditioner.

To achieve the above object, the present invention provides a method for manufacturing a chemical mechanical polishing conditioner, comprising: (A) providing a non-planar substrate; (B) providing a binding layer disposed on the surface of the non-planar substrate; (C) providing a plurality of abrasive particles embedded in a surface of the binding layer, and (D) heat curing the binding layer, such that the non-planar substrate is deformed into a planar substrate during curing the binding layer, and the abrasive particles are fixed to a surface of the planar substrate by the binding layer; wherein, after step (D), tips of the abrasive particles have a leveled height.

In the method for manufacturing a chemical mechanical polishing conditioner of the present invention, the surface of the non-planar substrate has a center surface and an outer edge surface, and a working surface is formed between the center surface and the outer edge surface.

In the method for manufacturing a chemical mechanical polishing conditioner of the present invention, the working surface may have a non-planar contour, wherein the non-planar contour may be spherical or non-spherical.

In the method for manufacturing a chemical mechanical polishing conditioner of the present invention, a height difference between the center surface and the outer edge surface may be 5-5000 μm. In a preferred aspect of the present invention, a height difference between the center surface and the outer edge surface may be 120 μm.

In the method for manufacturing a chemical mechanical polishing conditioner of the present invention, the method for heat curing the binding layer may be brazing, heat-curing, ultraviolet radiation curing, electroplating, or sintering. In a preferred aspect of the present invention, the method for heat curing the binding layer may be brazing.

In the method for manufacturing a chemical mechanical polishing conditioner of the present invention, the abrasive particles may be diamond or cubic boron nitride. In a preferred aspect of the present invention, the abrasive particles may be diamond. In addition, in the method for manufacturing a chemical mechanical polishing conditioner of the present invention, the abrasive particles may have a particle size of 20-450 μm. In a preferred aspect of the present invention, the abrasive particles may have a particle size of 200 μm.

In the method for manufacturing a chemical mechanical polishing conditioner of the present invention, in the aforementioned step (C), the abrasive particles may be embedded in the surface of the binding layer by a template, a platen, or a temporary mold.

In summary, according to the method for manufacturing a chemical mechanical polishing conditioner of the present invention, the problem of the deformation of the substrate of the chemical mechanical polishing conditioner during curing may be effectively solved, and the surface flatness of the chemical mechanical polishing conditioner may be improved, thereby increasing the polishing efficiency and service life of the conditioner.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Hereinafter, the actions and the effects of the present invention will be explained in more detail via specific examples of the invention. However, these examples are merely illustrative of the present invention and the scope of the invention should not be construed to be defined thereby.

COMPARATIVE EXAMPLE 1

Refer to FIGS. 1A to 1D, showing the conventional process flow for manufacturing a chemical mechanical polishing conditioner.

Figure 1A:
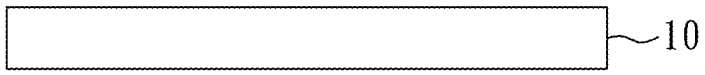
FIG. 1A Prior Art
FIGS. 1A to 1D show a conventional process flow for manufacturing a chemical mechanical polishing conditioner.
Figure 1B:
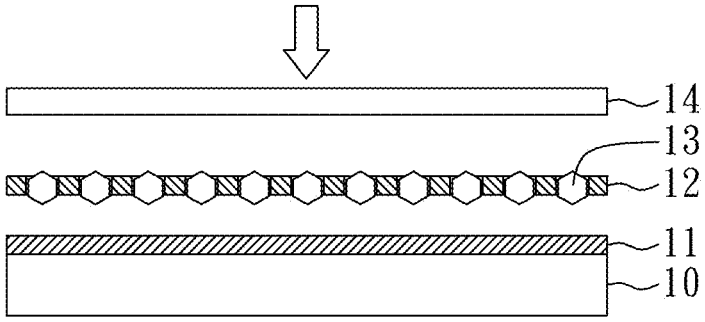
FIG. 1B Prior Art

First, as shown in FIGS. 1A and 1B, a binding layer 11 is formed on a working surface of a substrate 10 having a planar contour, and the abrasive particles 13 are employed, wherein the spacing and arrangement of the abrasive particles 13 are controlled by using template 12 while a rigid plate 14 is provided to press down the abrasive particles 13.

Figure 1C:
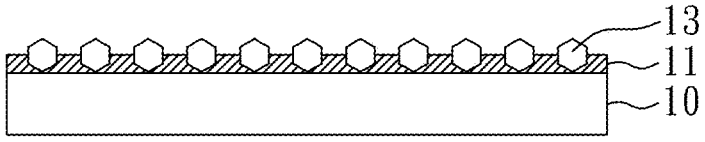
FIG. 1C Prior Art

Then, as shown in FIG. 1C, after the abrasive particles 13 are pressed down by the rigid plate 14, the abrasive particles 13 are embedded and fixed in the abrasive layer 11, and the surfaces of the abrasive particles 13 and the rigid flat 14 may have the same flatness.

Figure 1D:
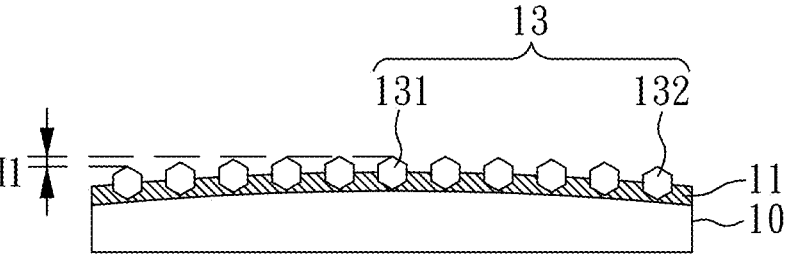
FIG. 1D Prior Art

Finally, as shown in FIG. 1D, the abrasive particles 13 are fixed to the surface of the substrate 10 by a heat-curing process through the binding layer 11. However, the substrate 10 of the chemical mechanical polishing conditioner may be deformed after curing because of the difference in thermal expansion coefficient between the binding layer 11 and the substrate 10, and thus the binding layer 11 and the abrasive particles 13 on the surface of the substrate are also deformed thereby deteriorating the flatness of the abrasive particles of the conditioner, wherein tips of the center abrasive particles 131 are relatively high, while the tips of the outer edge abrasive particles 132 are relatively low, resulting in a height difference H1 between the center abrasive particles 131 and the outer edge abrasive particles 132.

In Comparative Example 1, the binding layer 11 is made of common nickel-based metal brazing and the substrate 10 is made of stainless steel.

COMPARATIVE EXAMPLE 2

Please refer to FIGS. 2A to 2E, showing another conventional process flow for manufacturing a chemical mechanical polishing conditioner.

Figure 2A:
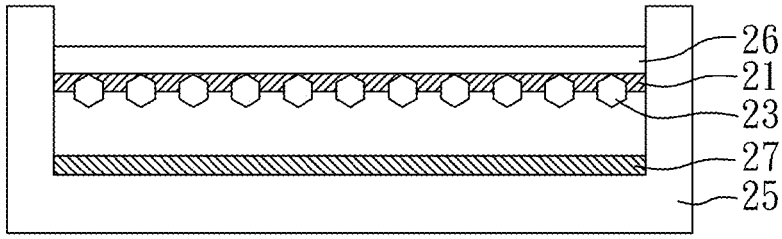
FIG. 2A Prior Art
FIGS. 2A to 2E show another conventional process flow for manufacturing a chemical mechanical polishing conditioner.
Figure 2B:
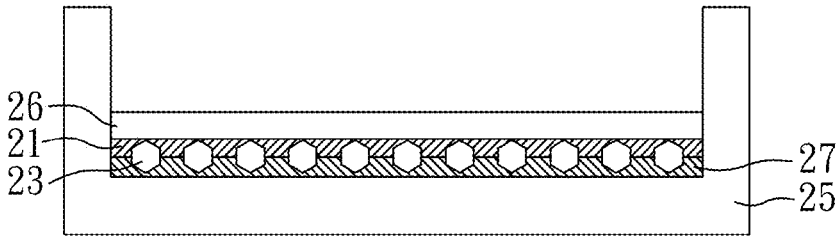
FIG. 2B Prior Art

First, as shown in FIGS. 2A and 2B, a mold 25 is provided, wherein the mold 25 has a recess structure, and a binding agent 27 is disposed in the mold 25. Then, abrasive particles 23 and a binding layer 21 are provided and fixed on a soft substrate 26, and after that, the soft substrate 26 is disposed on the surface of the binding agent 27 in the mold 25, and the abrasive particles 23 are attached to the surface of the recess in the mold 25 by the binding agent 27, such that the abrasive particles 23 may be provided have the same flatness with the surface of the recess in the mold 25.

Figure 2C:
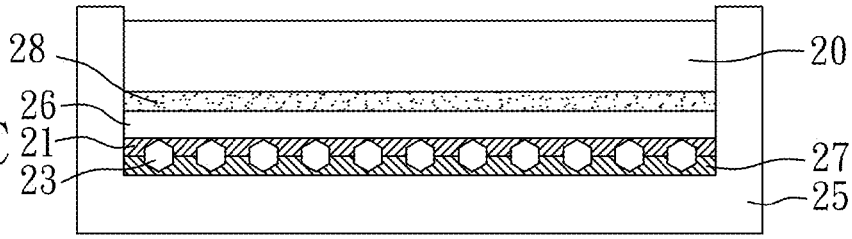
FIG. 2C Prior Art

Subsequently, as shown in FIG. 2C, an adhesive layer 28 and a substrate 20 are provided and attached onto the soft substrate 26, such that the abrasive particles 23 on the surface of the soft substrate 26 and the binding layer 21 can be combined to the substrate 20 by the adhesive layer 28, wherein the surface of the substrate 20 has a planar contour.

Figure 2D:
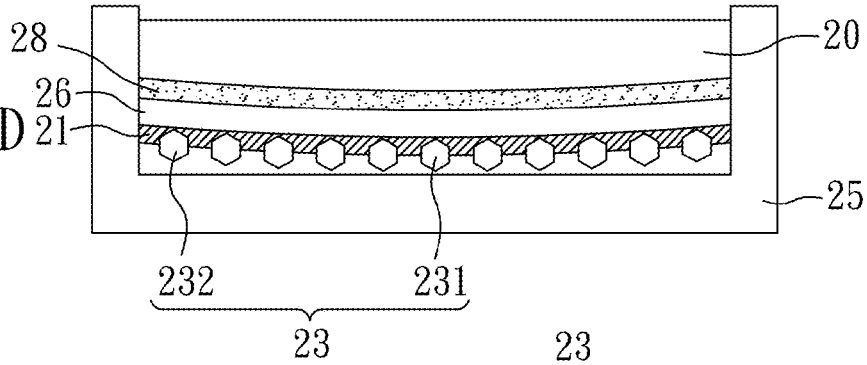
FIG. 2D Prior Art

Then, as shown in FIG. 2D, the abrasive particles 23 are fixed to the substrate 20 by the binding layer 21, the soft substrate 26 and the adhesive layer 28 through a heat curing process. However, the substrate 20 of the chemical mechanical polishing conditioner may be deformed after curing, because of the difference in thermal expansion coefficient between the binding layer 21 and the substrate 20, resulting in deformation of the binding layer 21 on the surface of the substrate 20 and the abrasive particles 23, thus destroying the flatness of the abrasive particles 23 of the conditioner, wherein the center abrasive particles 231 and the outer edge abrasive particles 232 have different tip heights.

Figure 2E:
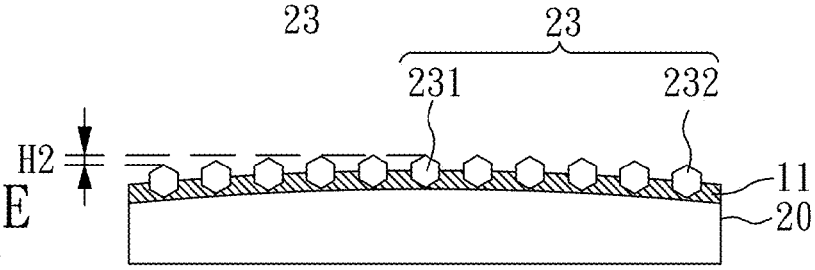
FIG. 2E Prior Art

Finally, as shown in FIG. 2E, the aforementioned cured chemical mechanical polishing conditioner is removed from the recess in the mold 25, and the binding layer 21 on the surface of the substrate 20 and the abrasive particles 23 have been deformed, thereby destroying the flatness of the abrasive particles 23 on the surface of the chemical mechanical polishing conditioner, wherein tips of the center abrasive particles 231 are relatively high, while the tips of the outer edge abrasive particles 232 are relative low, such that a height difference 112 between the center abrasive particles 231 and the outer edge abrasive particles 232 is formed.

In Comparative Example 2, the binding layer 21 is made of common nickel-based metal brazing, the substrate 20 is made of stainless steel, the binding agent 27 is wax, and the soft substrate 26 is a metal foil.

COMPARATIVE EXAMPLE 3

Figure 3A:
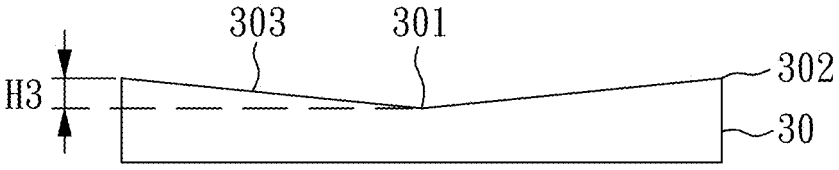
FIG. 3A Prior Art
FIGS. 3A to 3C' show a further conventional process flow for manufacturing a chemical mechanical polishing conditioner.
Figure 3B:
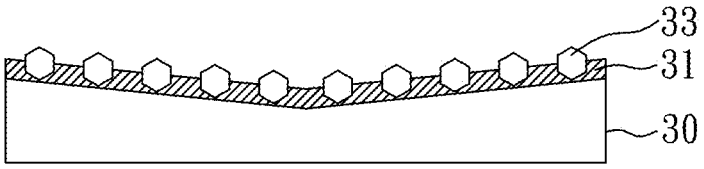
FIG. 3B Prior Art
Figure 3C:
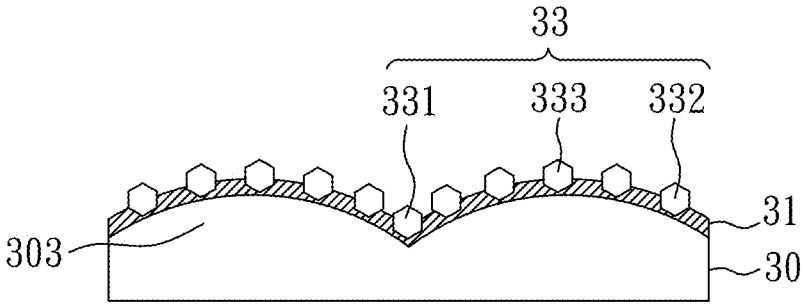
FIG. 3C Prior Art
Figure 3C:
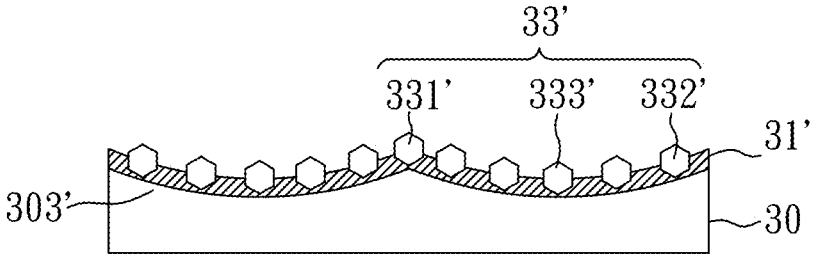
FIG. 3C' Prior Art

Refer to FIGS. 3A to 3C', showing a further conventional process flow for manufacturing a chemical mechanical polishing conditioner. The manufacturing process of Comparative Example 3 is substantially the same as the above Comparative Example 1, except that the substrate in Comparative Example 1 or Comparative Example 2 is selected to have a planar contour, while the substrate in Comparative Example 3 is selected to have a non-planar contour.

First, as shown in FIG. 3A, a substrate 30 having a non-planar contour is provided, wherein a working surface 303 having a linear surface is formed between the center surface 301 and the outer edge surface 302, and the height of the substrate is gradually increased from the center surface 301 to the outer edge surface 302. In addition, the height of the center surface 301 is lower and the outer edge height of the surface 302 is higher, such that a height difference H3 between the center surface 301 and the outer edge surface 302 is formed.

Next, as shown in FIG. 3B, a binding layer 31 and the abrasive particles 33 are disposed on the working surface 303 of the substrate 30, wherein the binding layer 31 and the abrasive particles 33 may be optionally disposed by the method disclosed in Comparative Example 1 or Comparative Example 2 to control the arrangement or surface flatness of the abrasive particles 33.

Then, as shown in FIG. 3C, the abrasive particles 33 are fixed to the substrate 30 by the binding layer 31 through a heat curing process. However, the substrate 30 of the chemical mechanical polishing conditioner may be deformed after curing, because of the difference in thermal expansion coefficient between the binding layer 31 and the substrate 30, resulting in deformation of the binding layer 31 on the surface of the substrate 30 and the abrasive particles 33, thus destroying the flatness of the abrasive particles 33 of the chemical mechanical polishing conditioner.

In Comparative Example 3, the binding layer 31 is made of common nickel-based metal brazing, and the substrate 30 is made of stainless steel. In Comparative Example 3, since the thermal expansion coefficient of the substrate 30 is selected to be higher than that of the binding layer 31, the working surface 303 of the substrate 30 after heat-curing will present a upward-protruding curved surface, wherein tips of the center abrasive particles 331 and the tips of the outer edge abrasive particles 332 are relatively low, while tips of the therebetween abrasive particles 333 are relatively high.

Further, FIG. 3C' shows another aspect of Comparative Example 3. If the thermal expansion coefficient of the selected substrate 30 is lower than that of the binding layer 31', the substrate 30 of the chemical mechanical polishing conditioner may be deformed after curing, because of the difference in thermal expansion coefficient between the binding layer 31' and the substrate 30, resulting in deformation of the binding layer 31' on the surface of the substrate 30 and the abrasive particles 33, and destroying the flatness of the abrasive particles 33' of the chemical mechanical polishing conditioner, the working surface 303' of the substrate 30 after heat-curing will present a downward-protruding curved surface, wherein tips of the center abrasive particles 331 and the tips of the outer edge abrasive particles 332' are relatively high, while tips of the therebetween abrasive particles 333' are relatively low.

EXAMPLE

Figure 4A:
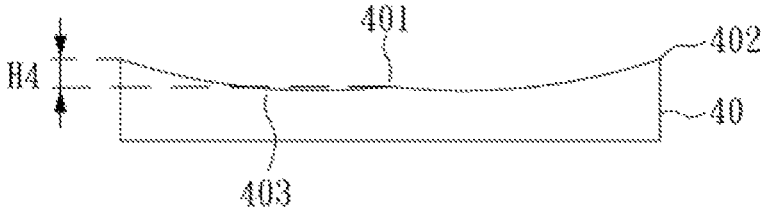
FIGS. 4A to 4C show a process flow for manufacturing the chemical mechanical polishing conditioner of the present invention.
Figure 4B:
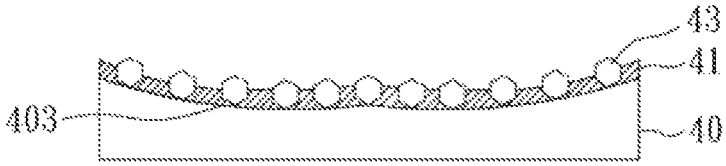
Figure 4C:
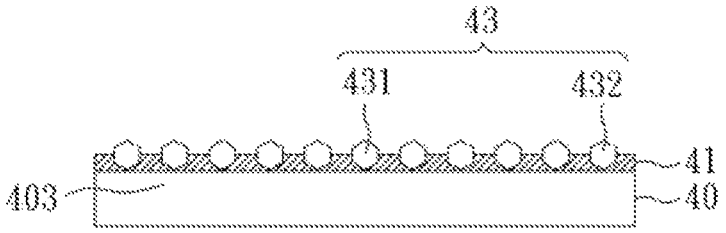

Please refer to FIGS. 4A to 4C, showing the process flow for manufacturing the chemical mechanical polishing conditioner of the present invention. The manufacturing process of this Example is substantially the same as the above Comparative Example 3, except that the working surface of substrate in this Example is selected to have a non-planar contour, while the working surface of the substrate in Comparative Example 3 is selected to have a linear contour.

First, as shown in FIG. 4A, a substrate 40 having a non-planar contour is provided, wherein a working surface 403 having a non-planar surface is formed between the center surface 401 at and the outer edge surface 402, and the non-planar surface may comprise a spherical contour or a non-spherical contour. In this Example, the working surface 403 has a non-spherical curved contour. In addition, the height of the center surface 401 is relative low and the height of the outer edge surface 402 is relatively high, such that a height difference H4 between the center surface 401 and the outer edge surface 402 is formed. In this Example, the substrate 40 is a type 316 stainless steel having a thermal expansion coefficient of about 16 ppm/° C., and the substrate 40 has a diameter of 100 mm and a thickness of 6 mm. The height difference H4 formed between the center surface 401 and the outer edge surface 402 is 120 μm. That is, the height difference H4 formed between the center surface 401 and the outer edge surface 402 is 2% of the thickness of the substrate 40.

Then, as shown in FIG. 4B, a binding layer 41 and abrasive particles 43 are disposed on the working surface 403 of the substrate 40, wherein the binding layer 41 and the abrasive particles 43 may be optionally disposed by the method disclosed in Comparative Example 1 or Comparative Example 2 to control the arrangement or surface flatness of the abrasive particles 43. In this Example, the abrasive particles 43 are diamond having a particle size of 200 μm.

After that, as shown in FIG. 4C, the abrasive particles 43 are fixed to the substrate 40 by the binding layer 41 through a heat curing process. However, the substrate 40 of the chemical mechanical polishing conditioner may be deformed after curing, because of the difference in thermal expansion coefficient between the binding layer 41 and the substrate 40, resulting in deformation of the binding layer 41 on the surface of the substrate 40 and the abrasive particles 43. However, in this Example, the binding layer 41 is a brazing made of nickel, chromium, silicon, and boron, having a thermal expansion coefficient of about 14-15 ppm/° C., and since the thermal expansion coefficient of the substrate 40 is selected to be higher than the binding layer 41, the working surface 403 of the substrate 40 after heat-curing will present a upward-protruding curved surface. Referring back to FIG. 4A, however, since the working surface 403 of the substrate 40 in this Example has a non-spherical curved contour, and the working surface 403 is trimmed to have a recessed contour before heat-curing, the substrate 40 will be deformed to compensate the recessed surface of the working surface 403. Finally, the cured substrate 40 and the surface of the abrasive particles 43 show a high degree of flatness, and as a result, the tips of all the abrasive particles 43 (including the center abrasive particles 431 and the outer edge abrasive particles 432) have a leveled height.

It should be understood that these examples are merely illustrative of the present invention and the scope of the invention should not be construed to be defined thereby, and the scope of the present invention will be limited only by the appended claims.

What is claimed is:

1. A method for manufacturing a chemical mechanical polishing conditioner, comprising:

(A) providing a non-planar substrate;

(B) providing a binding layer disposed on the surface of the non-planar substrate;

(C) providing a plurality of abrasive particles embedded in a surface of the binding layer, and (D) heat curing the binding layer, such that the non-planar substrate is deformed into a planar substrate during curing the binding layer, and the abrasive particles are fixed to a surface of the planar substrate by the binding layer;

wherein, after step (D), tips of the abrasive particles have a leveled height;

wherein a surface of the non-planar substrate has a center surface and an outer edge surface, and a working surface is formed between the center surface and the outer edge surface; and wherein the working surface has a non-planar contour.

2. The method for manufacturing a chemical mechanical polishing conditioner of claim 1, wherein the non-planar contour is spherical.

3. The method for manufacturing a chemical mechanical polishing conditioner of claim 1, wherein a height difference between the center surface and the outer edge surface is 5-5000 μm.

4. The method for manufacturing a chemical mechanical polishing conditioner of claim 1, wherein the heat curing of the binding layer is performed by brazing, heat-curing, ultraviolet radiation curing, electroplating, or sintering.

5. The method for manufacturing a chemical mechanical polishing conditioner of claim 1, wherein the abrasive particles are diamond or cubic boron nitride.

6. The method for manufacturing a chemical mechanical polishing conditioner of claim 1, wherein the abrasive particles have a particle size of 20-450 μm.

7. The method for manufacturing a chemical mechanical polishing conditioner of claim 1, wherein, in the step (C), the abrasive particles are embedded in the surface of the binding layer by a template.

8. The method for manufacturing a chemical mechanical polishing conditioner of claim 1, wherein, in the step (C), the abrasive particles are embedded in the surface of the binding layer by a platen.

9. The method for manufacturing a chemical mechanical polishing conditioner of claim 1, wherein, in the step (C), the abrasive particles are embedded in the surface of the binding layer by a temporary mold.

10. The method for manufacturing a chemical mechanical polishing conditioner of claim 1, wherein the non-planar contour is non-spherical.

* * * * *